US008620487B2

(12) United States Patent
Cochran et al.

(10) Patent No.: US 8,620,487 B2
(45) Date of Patent: Dec. 31, 2013

(54) FOR A KIOSK FOR A VEHICLE SCREENING SYSTEM

(75) Inventors: Edward L. Cochran, Minneapolis, MN (US); Bruce W. Anderson, Andover, MN (US); Thomas R. Markham, Fridley, MN (US)

(73) Assignee: Honeywell International Inc., Morristown, NJ (US)

( * ) Notice: Subject to any disclaimer, the term of this patent is extended or adjusted under 35 U.S.C. 154(b) by 1516 days.

(21) Appl. No.: 11/639,815

(22) Filed: Dec. 15, 2006

(65) Prior Publication Data

US 2008/0147246 A1 Jun. 19, 2008

(51) Int. Cl.
*G07C 9/00* (2006.01)

(52) U.S. Cl.
USPC ..... 701/1; 340/5.2; 340/5.51; 340/5.52; 340/5.53; 340/5.54; 340/5.6; 340/5.8; 340/5.81; 340/5.82; 340/5.84; 340/5.85

(58) Field of Classification Search
USPC ..... 704/200, 270, 273; 705/1, 16, 18; 708/100; 382/100, 115, 118; 340/825, 340/5.1–5.85; 701/1, 2, 22, 36
See application file for complete search history.

(56) References Cited

U.S. PATENT DOCUMENTS

| | | | | |
|---|---|---|---|---|
| 5,488,360 | A * | 1/1996 | Ray | 340/933 |
| 5,644,119 | A | 7/1997 | Padula et al. | G06K 15/00 |
| 6,041,410 | A * | 3/2000 | Hsu et al. | 713/186 |
| 6,072,894 | A * | 6/2000 | Payne | 382/118 |
| 6,100,811 | A * | 8/2000 | Hsu et al. | 340/5.83 |
| 6,119,096 | A | 9/2000 | Mann et al. | 705/5 |
| 6,140,939 | A * | 10/2000 | Flick | 340/12.28 |
| 6,225,890 | B1 * | 5/2001 | Murphy | 340/426.19 |
| 6,496,107 | B1 * | 12/2002 | Himmelstein | 340/426.1 |
| 6,710,700 | B1 * | 3/2004 | Tatsukawa et al. | 340/5.53 |
| 6,898,299 | B1 * | 5/2005 | Brooks | 382/115 |
| 6,958,676 | B1 * | 10/2005 | Morgan et al. | 340/5.72 |
| 6,972,693 | B2 * | 12/2005 | Brown et al. | 340/907 |
| 6,999,606 | B1 | 2/2006 | Frischholz | 382/118 |
| 7,121,471 | B2 * | 10/2006 | Beenau et al. | 235/487 |

(Continued)

FOREIGN PATENT DOCUMENTS

| | | | | |
|---|---|---|---|---|
| EP | 1160734 A2 | 12/2001 | | G07B 15/00 |
| WO | WO 2006/041416 A1 | 4/2006 | | G08B 31/00 |
| WO | WO 2006/052683 A1 | 5/2006 | | G07B 15/04 |

OTHER PUBLICATIONS

PCT—Notification of Transmittal of the International Search Report and the Written Opinion of the International Searching Authority, or the Declaration, Date of Mailing: May 28, 2008.

(Continued)

*Primary Examiner* — Jonathan M Dager
(74) *Attorney, Agent, or Firm* — Kermit D. Lopez; Luis M. Ortiz; Kevin Soules

(57) ABSTRACT

A vehicle screening method and system. A vehicle occupant can be identified utilizing one or more biometric identifiers input by or obtained from the vehicle occupant via a biometric input device. A barcode can also be provided by the vehicle occupant from a scanned card or other structure upon which the barcode is maintained. Additionally, a unique identification number can be provided by the user in order to match the unique identification number against a database of identification numbers, thereby permitting the vehicle occupant to be remotely screened and verified for entry into a secure facility based on the biometric identifier(s), the barcode and the unique identification number.

16 Claims, 10 Drawing Sheets

(56) References Cited

U.S. PATENT DOCUMENTS

| | | | | |
|---|---|---|---|---|
| 7,159,778 | B1 * | 1/2007 | Kochevar et al. | 235/462.01 |
| 7,278,026 | B2 * | 10/2007 | McGowan | 713/186 |
| 7,439,847 | B2 * | 10/2008 | Pederson | 340/5.81 |
| 7,455,224 | B2 * | 11/2008 | Kochevar et al. | 235/382 |
| 7,692,530 | B2 * | 4/2010 | Turner et al. | 340/5.61 |
| 8,089,340 | B2 * | 1/2012 | Cochran et al. | 340/5.7 |
| 8,155,392 | B1 * | 4/2012 | McWilliams et al. | 382/115 |
| 2001/0054154 | A1 * | 12/2001 | Tam | 713/186 |
| 2002/0109580 | A1 * | 8/2002 | Shreve et al. | 340/5.61 |
| 2002/0186144 | A1 * | 12/2002 | Meunier | 340/825.28 |
| 2003/0004792 | A1 * | 1/2003 | Townzen et al. | 705/13 |
| 2003/0105964 | A1 * | 6/2003 | Brainard et al. | 713/178 |
| 2003/0225767 | A1 * | 12/2003 | Archibald et al. | 707/10 |
| 2004/0002894 | A1 * | 1/2004 | Kocher | 705/13 |
| 2004/0066273 | A1 * | 4/2004 | Cortina et al. | 340/5.1 |
| 2004/0151347 | A1 | 8/2004 | Wisniewski | 382/115 |
| 2004/0199785 | A1 * | 10/2004 | Pederson | 713/200 |
| 2004/0211883 | A1 * | 10/2004 | Imagawa et al. | 250/208.1 |
| 2004/0233036 | A1 * | 11/2004 | Sefton | 340/5.53 |
| 2004/0252013 | A1 * | 12/2004 | Fuks et al. | 340/5.52 |
| 2005/0063569 | A1 | 3/2005 | Colbert et al. | 382/118 |
| 2006/0001523 | A1 * | 1/2006 | Underdahl et al. | 340/5.64 |
| 2006/0082438 | A1 | 4/2006 | Bazakos et al. | 340/5.82 |
| 2006/0082439 | A1 * | 4/2006 | Bazakos et al. | 340/5.82 |
| 2006/0089754 | A1 | 4/2006 | Mortenson | 701/1 |
| 2006/0097844 | A1 * | 5/2006 | Nakashima et al. | 340/5.52 |
| 2006/0261931 | A1 * | 11/2006 | Cheng | 340/426.1 |
| 2007/0057763 | A1 * | 3/2007 | Blattner et al. | 340/5.52 |
| 2007/0150336 | A1 * | 6/2007 | Boily | 705/13 |
| 2007/0241861 | A1 * | 10/2007 | Venkatanna et al. | 340/5.52 |
| 2007/0276944 | A1 * | 11/2007 | Samovar et al. | 709/225 |
| 2008/0164974 | A1 * | 7/2008 | Cochran et al. | 340/5.83 |
| 2009/0101708 | A1 * | 4/2009 | Kochevar et al. | 235/382 |

OTHER PUBLICATIONS

Integrated AUVIS, Gatekeeper Security, www.gatekeepersecurity.com.

* cited by examiner

FOR A KIOSK FOR A VEHICLE SCREENING SYSTEM

TECHNICAL FIELD

Embodiments are generally related to data-processing devices and techniques. Embodiments are also related to vehicle screening systems and methods. Embodiments are additionally related to biometric identification techniques. Embodiments are also related to electronic kiosks and related devices.

BACKGROUND

The expansion of terrorism throughout the world has resulted in increased hazards to many cultures, particularly relatively free and open societies such as the United States of America. In such an open society, it is relatively easy to do a great deal of damage, as evidenced by "car bombs," i.e., automobiles or other vehicles loaded with explosives and detonated beneath or near a building structure.

Such motor vehicles are also used for concealing and smuggling various types of weaponry and contraband (drugs, etc.). Authorities are well aware of the potential hazards of such concealed articles and materials, and a number of automated inspection devices employing different principles of operation have been developed in response. Nevertheless, the inspection of every vehicle passing a given point or location is generally impractical in most instances. This is particularly true for large scale events, e.g. major sporting events, public events at military bases, facilities providing daily employment to large numbers of workers and staff, etc.

Presently, inspection devices employing one principle of operation are utilized for detecting explosives, and another principle or principles is/are used for the detection of concealed weapons. These various detection devices are independent of one another and must be used separately in any given inspection station or location. In many instances, authorities simply cannot provide the number of personnel required to perform all of the inspections necessary to completely inspect all vehicles passing through a given checkpoint. Even if it were possible to provide sufficient personnel, this would clearly add considerably to the time involved in a detailed inspection of every vehicle passing through a given inspection point.

It is therefore believed that one solution to these problems involves the design and implementation of a self-screening system for permitting vehicles to pass through security gates in order to gain access to a facility or area.

BRIEF SUMMARY

The following summary is provided to facilitate an understanding of some of the innovative features unique to the embodiments and is not intended to be a full description. A full appreciation of the various aspects of the embodiments disclosed can be gained by taking the entire specification, claims, drawings, and abstract as a whole.

It is, therefore, one aspect of the present invention to provide for improved data-processing techniques and devices.

It is yet another aspect of the present invention to provide for kiosk-based vehicle screening system.

The aforementioned aspects of the invention and other objectives and advantages can now be achieved as described herein. A vehicle screening method and system is disclosed. A vehicle occupant can be identified utilizing one or more biometric identifiers input by or obtained from the vehicle occupant via a biometric input device. A one or two dimensional barcode can also be provided by the vehicle occupant from a scanned card or other structure upon which the barcode is maintained. Additionally a Radio Frequency Identification (RFID) device or smartcard may be used to communicate information about the driver, passenger or vehicle. Additionally, a unique identification number can be provided by the user in order to match the unique identification number against a database of identification numbers, thereby permitting the vehicle occupant to be remotely screened and verified for entry into a secure facility based on the biometric identifier(s), the barcode and the unique identification number. The vehicle itself may also be identified by an automated license plate reader as well as images of the vehicle.

The method and system disclosed herein involves the use of a drive-up electronic kiosk for screening vehicles and their occupants prior to entering a secured facility. The method and system can be used to screen a vehicle and verify the identity of its occupants at a safe distance from the entrance to a secured facility. Biometric identification can be utilized to scan and identify the face of a vehicle occupant, the speech/voice associated with the vehicle occupant, and the iris of the vehicle occupant. Identification (ID) cards provided by the vehicle occupant can be scanned using barcode and/or other ID scanners. The drive-up electronic kiosk discussed herein enables a vehicle occupant to enter a unique ID number. The combination of these three elements—something that a vehicle occupant has, something the vehicle occupant knows, and his or her appearance—permit effective occupant screening from a safe distance.

The system may include a database of both authorized and unauthorized individuals and vehicles. This database is automatically checked using information obtained from the vehicle and its occupants.

The drive-up electronic kiosk can include in some embodiments, a touch screen for use by the vehicle driver to enter information, one or more card readers to obtain information the driver's license or ID cards, one or more cameras to obtain real time (RT) video of the vehicle occupant(s), including snapshots of the faces of the occupants, along with a microphone and speakers for interacting with the driver. These components are provided in the context of an environmentally controlled housing intended for all weather use.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the principles of the disclosed embodiments.

DETAILED DESCRIPTION

The particular values and configurations discussed in these non-limiting examples can be varied and are cited merely to illustrate at least one embodiment and are not intended to limit the scope of the invention.

Figure 1:
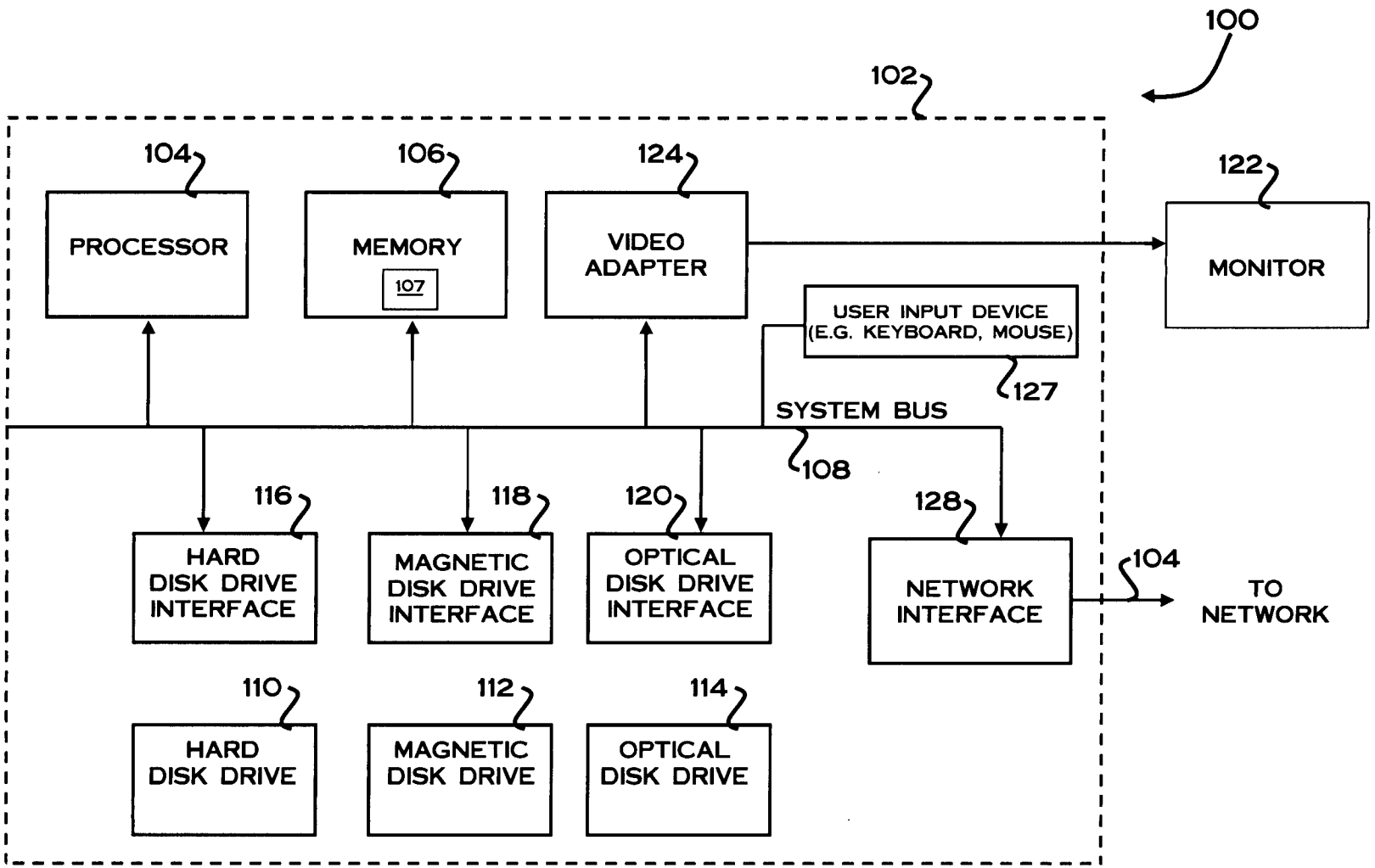
FIG. 1 illustrates a block diagram of a data-processing apparatus, which can be adapted for use in implementing a preferred embodiment.

FIG. 1 illustrates a block diagram of a data-processing apparatus 100, which can be utilized in accordance with a preferred embodiment. Data-processing apparatus 100 (e.g., a computer) can be utilized in the context of the vehicle screening system 200 disclosed in further detail here. Data-processing apparatus 100 can be configured to include a general purpose computing device, such as a computer 102. The computer 102 includes a processing unit 104, a memory 106, and a system bus 108 that operatively couples the various system components to the processing unit 104. One or more processing units 104 operate as either a single central processing unit (CPU) or a parallel processing environment.

The data-processing apparatus 100 further includes one or more data storage devices for storing and reading program and other data. Examples of such data storage devices include a hard disk drive 110 for reading from and writing to a hard disk (not shown), a magnetic disk drive 112 for reading from or writing to a removable magnetic disk (not shown), and an optical disc drive 114 for reading from or writing to a removable optical disc (not shown), such as a CD-ROM or other optical medium. A monitor 122 is connected to the system bus 108 through an adapter 124 or other interface. Additionally, the data-processing apparatus 100 can include other peripheral output devices (not shown), such as speakers and printers. Additionally, a user input device 127 such as a keyboard and/or mouse can be connected to system bus 108 in order to permit users to input data, commands and instructions to data-processing apparatus 100.

The hard disk drive 110, magnetic disk drive 112, and optical disc drive 114 are connected to the system bus 108 by a hard disk drive interface 116, a magnetic disk drive interface 118, and an optical disc drive interface 120, respectively. These drives and their associated computer-readable media provide nonvolatile storage of computer-readable instructions, data structures, program modules, and other data for use by the data-processing apparatus 100. Note that such computer-readable instructions, data structures, program modules, and other data can be implemented as a module 107.

Note that the embodiments disclosed herein can be implemented in the context of a host operating system and one or more module(s) 107. In the computer programming arts, a software module can be typically implemented as a collection of routines and/or data structures that perform particular tasks or implement a particular abstract data type.

Software modules generally comprise instruction media storable within a memory location of a data-processing apparatus and are typically composed of two parts. First, a software module may list the constants, data types, variable, routines and the like that can be accessed by other modules or routines. Second, a software module can be configured as an implementation, which can be private (i.e., accessible perhaps only to the module), and that contains the source code that actually implements the routines or subroutines upon which the module is based. The term module, as utilized herein can therefore refer to software modules or implementations thereof. Such modules can be utilized separately or together to form a program product that can be implemented through signal-bearing media, including transmission media and recordable media.

It is important to note that, although the embodiments are described in the context of a fully functional data-processing apparatus such as data-processing apparatus 100, those skilled in the art will appreciate that the mechanisms of the present invention are capable of being distributed as a program product in a variety of forms, and that the present invention applies equally regardless of the particular type of signal-bearing media utilized to actually carry out the distribution. Examples of signal bearing media include, but are not limited to, recordable-type media such as floppy disks or CD ROMs and transmission-type media such as analogue or digital communications links.

Any type of computer-readable media that can store data that is accessible by a computer, such as magnetic cassettes, flash memory cards, digital versatile discs (DVDs), Bernoulli cartridges, random access memories (RAMs), and read only memories (ROMs) can be used in connection with the embodiments.

A number of program modules can be stored or encoded in a machine readable medium such as the hard disk drive 110, the, magnetic disk drive 114, the optical disc drive 114, ROM, RAM, etc or an electrical signal such as an electronic data stream received through a communications channel. These program modules can include an operating system, one or more application programs, other program modules, and program data.

The data-processing apparatus 100 can operate in a networked environment using logical connections to one or more remote computers (not shown). These logical connections are implemented using a communication device coupled to or integral with the data-processing apparatus 100. The data sequence to be analyzed can reside on a remote computer in the networked environment. The remote computer can be another computer, a server, a router, a network PC, a client, or a peer device or other common network node. FIG. 1 depicts the logical connection as a network connection 126 interfacing with the data-processing apparatus 100 through a network interface 128. Such networking environments are commonplace in office networks, enterprise-wide computer networks, intranets, and the Internet, which are all types of networks. It will be appreciated by those skilled in the art that the network connections shown are provided by way of example and that other means of and communications devices for establishing a communications link between the computers can be used.

Figure 2:
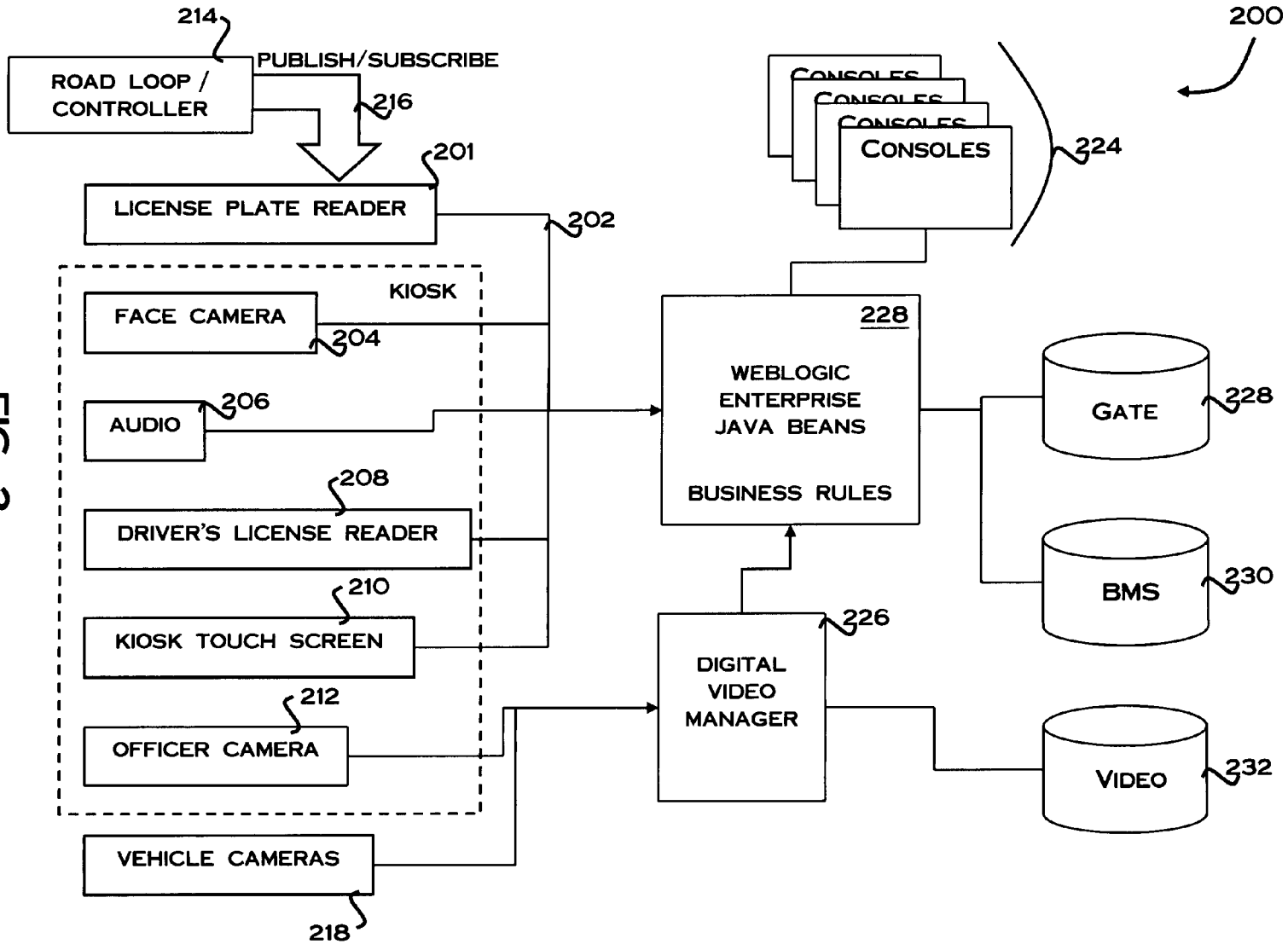
FIG. 2 illustrates a block diagram of a system, which can be implemented in accordance with a preferred embodiment.

FIG. 2 illustrates a block diagram of a system 200, which can be implemented in accordance with a preferred embodiment. System 200 generally includes a kiosk 202 composed of a face camera 204, an audio component 206, a driver's license reader 208, a kiosk touch screen 210, and officer camera 212. The face camera 204 and other similar face cameras can be employed in the context of a facial biometric identification device for identifying the faces of vehicle occupants. System 200 also includes one or more vehicle cameras 218 and a license plate reader 201. Data generated from the vehicle camera(s) 218 can be transmitted to a digital video manager 226. Data generated from the officer camera 212 can also be transmitted to the digital video manager 226. Data generated by the license plate reader 201, the face camera 204, the audio component 206, the driver's license reader 208 and/or the kiosk touch screen 210 can be transmitted to a module 220 that implements Web Logic java "beans" algorithms, database functions and/or business rules. Note that module 220 can be implemented as a module such as module 107 depicted in FIG. 1.

Data generated by the digital video manager 226 can also be transmitted to module 220 for processing by module 220. Data generated by the module 220 can then be provided to one or more consoles 224, which are described in greater detail herein. Data processed by module 220 can also be provided to a gate database 228 and a Biometric Management System database 230. Data generated by the digital video manager 226 can also be stored in a video database 232. Additionally, a road loop/controller or other vehicle sensing device such as an infrared beam unit 214 can publish event information as indicated by arrow 216, which is then provided to and/or accessed by elements of the system which subscribe to these events. Elements which may subscribe to the vehicle event s include but are not limited to the license plate reader 201, Face camera 204, audio 206, kiosk touch screen 210 and vehicle cameras 218.

Figure 3:
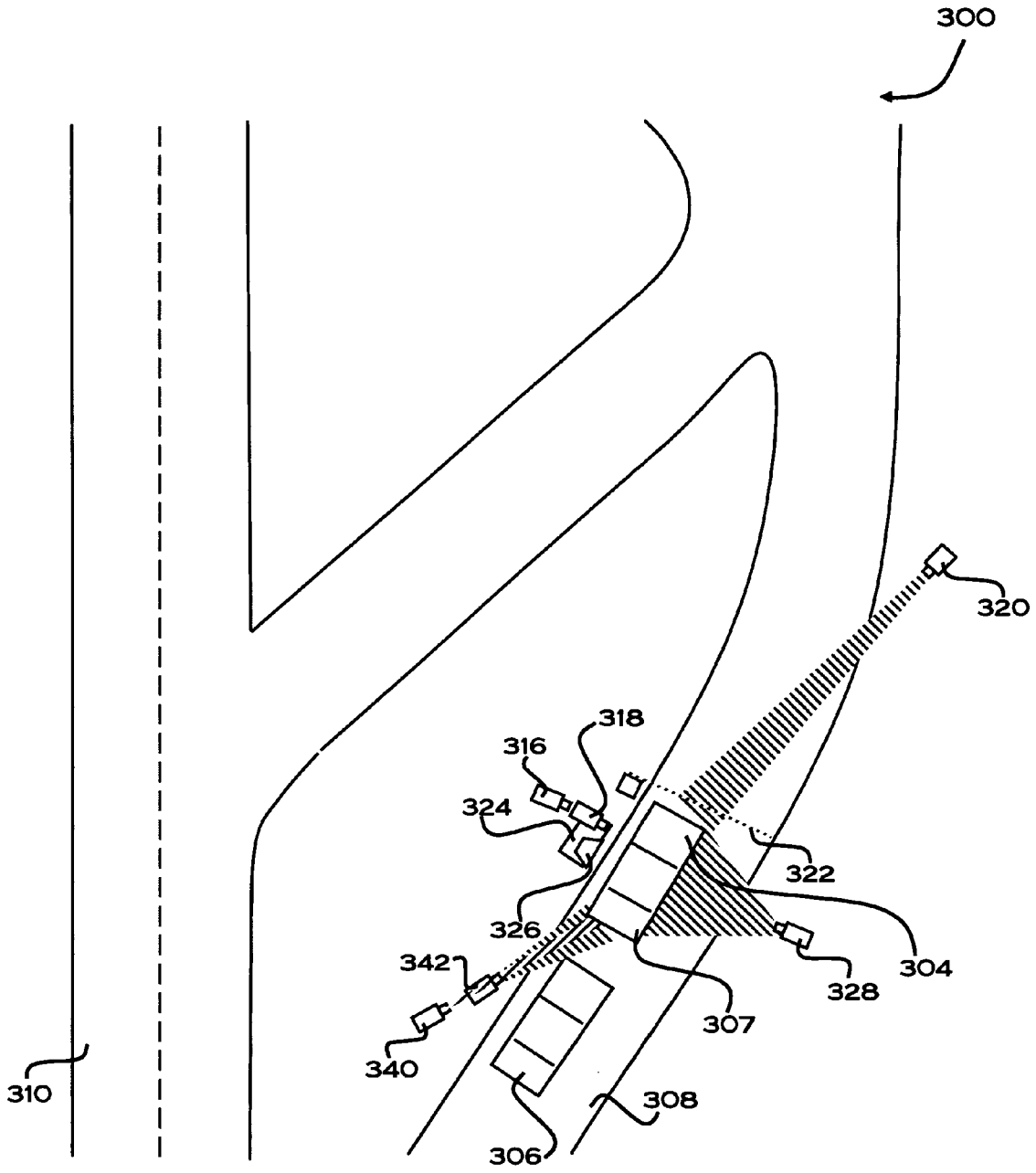
FIG. 3 illustrates a schematic diagram of a sensor field, in accordance with a preferred embodiment.

FIG. 3 illustrates a schematic diagram of a sensor field 300, in accordance with a preferred embodiment. The example depicted in FIG. 3 is merely illustrative in nature, and it can be appreciated that a variety of alternative embodiments may be implemented for sensor field 300, depending upon design considerations. As indicated in the example scenario of FIG. 3, three vehicles 306, 307, and 302 are shown progressing along a road or vehicle lane 308. Vehicle 307 is shown stopped or approaching the front of a gate 322. Vehicle 302 is also shown located in front of a gate 314. A camera 320 has a view of the front of car 307. An officer's camera 316, which is analogous or similar to the officer camera 212 depicted in FIG. 2, is located proximate to a face camera 318, which is also analogous or similar to the face camera 204 depicted in FIG. 2. An officer's intercom 326 is also located proximate to the face camera 318 and associated with an ID reader and keypad component 326. Additionally, a camera 340 and a camera 342 that can perform a license plate recognition operation are preferably positioned to view the rear of car 307. Note that the officer's intercom 324 the ID reader and keypad component 326, the officer's camera 316 and the face camera 318 can be implemented in the context of a system such as system 200 and the kiosk 202 depicted in FIG. 2.

Figure 4:
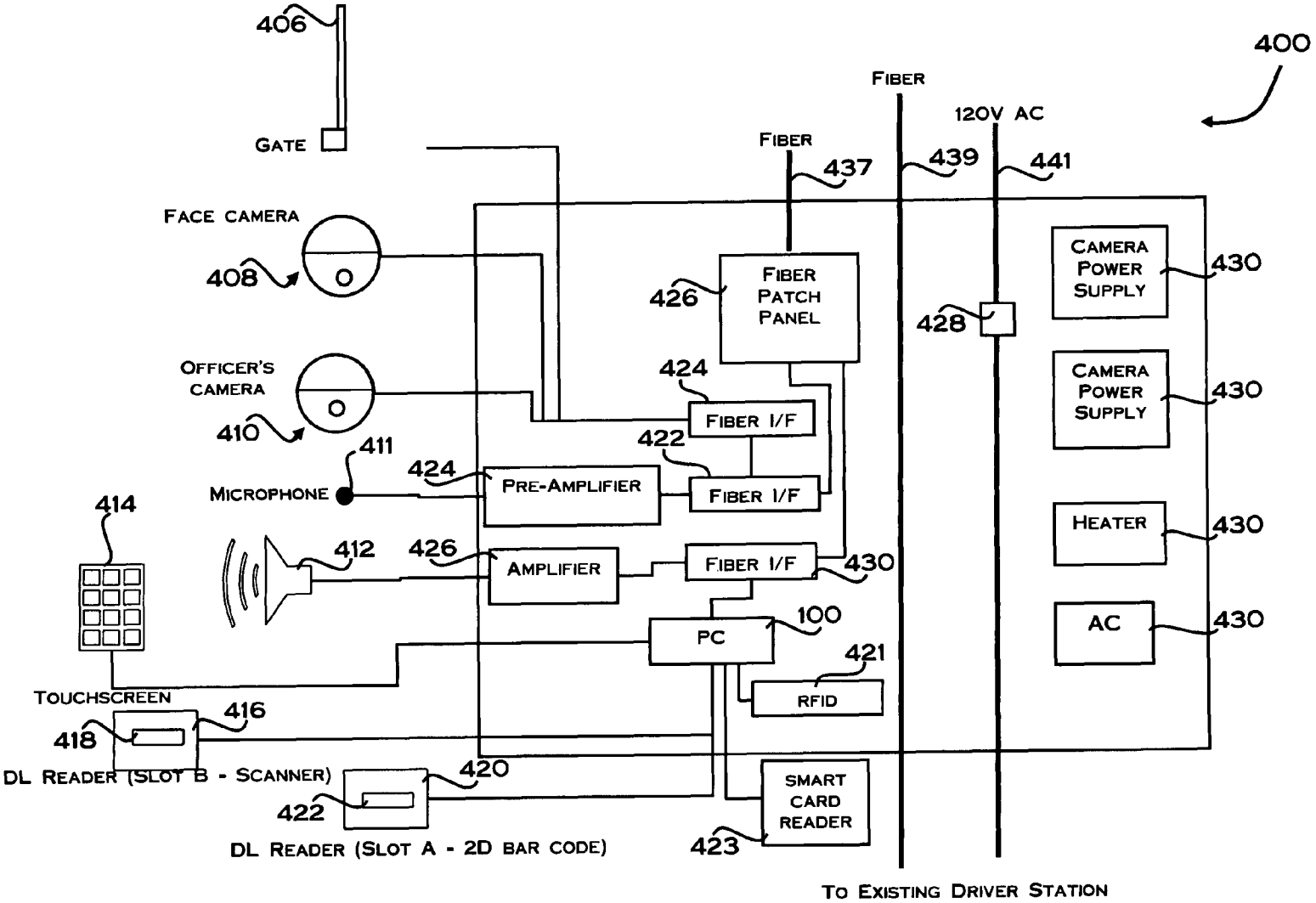
FIG. 4 illustrates a block diagram of a kiosk, which can be implemented in accordance with an alternative embodiment.

FIG. 4 illustrates a block diagram of a kiosk 400, which can be implemented in accordance with an alternative embodiment. Note that kiosk 400 is analogous to the kiosk 202 of system 200 described earlier. Kiosk 400 thus represents an alternative implementation of kiosk 202. In general, kiosk 400 is associated with a gate 406, which is analogous, for example, to gates 322 depicted in FIG. 4. Kiosk 400 includes a microphone 411 (analogous to the audio component 206 of FIG. 2) that is connected to a preamplifier 424, which in turn is connected to a Fiber I/F unit 422 that is connected to a fiber patch panel 426. The microphone 411 can be used for speech identification. A vehicle occupant speaks into the occupant to provide his or her voice for speech verification purposes. Kiosk 400 also includes an officer's camera 410, which is analogous to the officer camera 212 of FIG. 2 and the officer camera 316 of FIG. 3.

The officer's camera 410 is connected to a Fiber I/F unit 424, which in turn is connected to a fiber patch panel 426. A face camera 408 is also provided as a part of kiosk 400. The face camera 408 is analogous to the face camera 204 of FIG. 2 and the face camera 318 of FIG. 3. The face camera 408 is generally connected to the Fiber I/F unit 424 along with the officer's camera 410. A speaker 412 is also provided as a part of kiosk 400. The speaker 412 is also analogous to the audio component 206 depicted in FIG. 2. Speaker 412 is connected to an amplifier 426, which is connected to a Fiber I/F unit 430. The Fiber I/F unit 430 is connected to the fiber patch panel 426. The Fiber I/F unit 430 is connected to the data processing apparatus 100 depicted in FIG. 1.

Note that the data-processing apparatus 100 or another type of computer can be utilized in association with the configuration depicted in FIG. 4. A DL Reader 416 having a reader slot 418 is connected to the apparatus 100, along with a DL Reader 420 having a reader slot 422. Note that the DL reader 420 is a barcode reader that can read a two-dimensional bar code associated with a user identification card that belongs to a vehicle occupant. Note that although readers 416 and 420 are depicted in FIG. 4, it can be appreciated that the system and method described herein can also utilizes reader devices that rely on Radio Frequency Identification (RFID), near field communications and smartcard technologies which use radio frequency instead of optical means to communicate information. For example, a vehicle occupant may possess a card having an RFID tag that can be automatically scanned by a wireless RFID reader 421 associated with the kiosk 400 in order to assist in verifying the identity of the vehicle occupant. Similarly, the identification card belong to the vehicle occupant can be, for example, a smart card and a smart card reader 423 may be employed by kiosk 400 instead of and/or in addition to readers 416 and 420.

Kiosk 400 additionally includes two lines 439 and 441 which can electrically or optically connect to the processing and display elements of the system. A fiber line 437 is generally connected to the fiber patch panel 426. Kiosk 400 also includes one or more camera power supplies 430 and 432 in addition to a heater unit 434 and an AC unit 426. Note that the pre-amplifier 424, the amplifier 426, the apparatus 100, the Fiber I/F units 430, 422, 424 and the fiber patch panel 426 are a part of the general kiosk unit 402 in addition to the camera power supplies 430, 432 and the heater 434 and AC unit 436.

Figure 5:
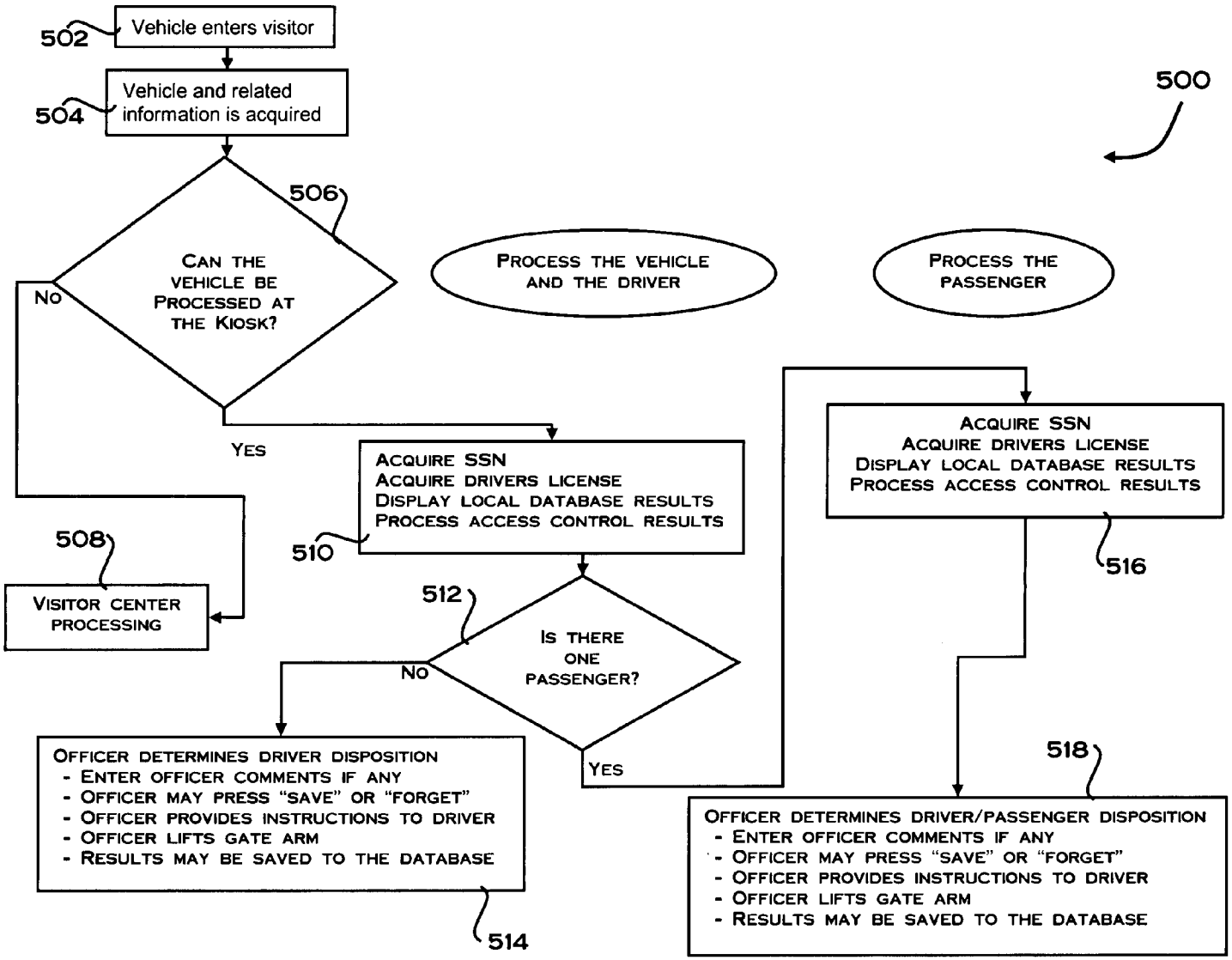
FIG. 5 illustrates a high-level flow chart of operations depicting a method that can be implemented in accordance with a preferred embodiment.

FIG. 5 illustrates a high-level flow chart of operations depicting a method 500 that can be implemented in accordance with a preferred embodiment. Note that the methodology depicted in FIGS. 5, 6, and 7 can be implemented in the context of a software module, such as module 107 (or group of modules) described earlier. As indicated at block 502, a vehicle enters a vehicle lane such as the vehicle lane or road 308 depicted in FIG. 3. Thereafter, as illustrated at block 504, vehicle and related information are acquired. Next, as indicated at block 506, a test can be performed to determine if the vehicle can be processed at a kiosk (e.g., kiosks 202 and/or 400). If it is determined that the vehicle cannot be processed at the kiosk, a visitor center processing operation is performed as indicated at block 508. That is, the vehicle driver is requested to visit a visitor center for processing before entry into a secured facility or area.

If it is determined that the vehicle can be processed, as depicted at block 506, an operation is then performed, as indicated at block 510, in which information is acquired, including an identification number such as a social security number (SSN), drivers license data. Additionally, as indicated at block 510, local database results can be gathered and access control results processed. Thereafter, as indicated at block 512 another test can be performed, this one involving a test to determine if there is one passenger? If there is more than one passenger, then an officer determines driver disposition by, for example, entering officer comments. The officer may press "save" or "forget" and enter his or comments into a data-processing apparatus. The officer can provide instructions to the driver or may actually lift the gate arm to allow the vehicle to pass through the gate. Results may be saved to a database.

If it is determined, that there is only one passenger, then an operation is performed, as depicted at block 516, in which the passenger is processed. That is, the SSN can be acquired, along with driver's license information, and local database results displayed. Additionally, access control results can be processed. Thereafter, as depicted at block 518, the officer can determine driver/passenger disposition. The office may enter comments, if any and can "save" or "forget" information regarding the vehicle and occupants. The officer can provide instructions to the driver and can life the gate arm to allow the vehicle to pass through the gate. Results can then be saved to the database.

Figure 6:
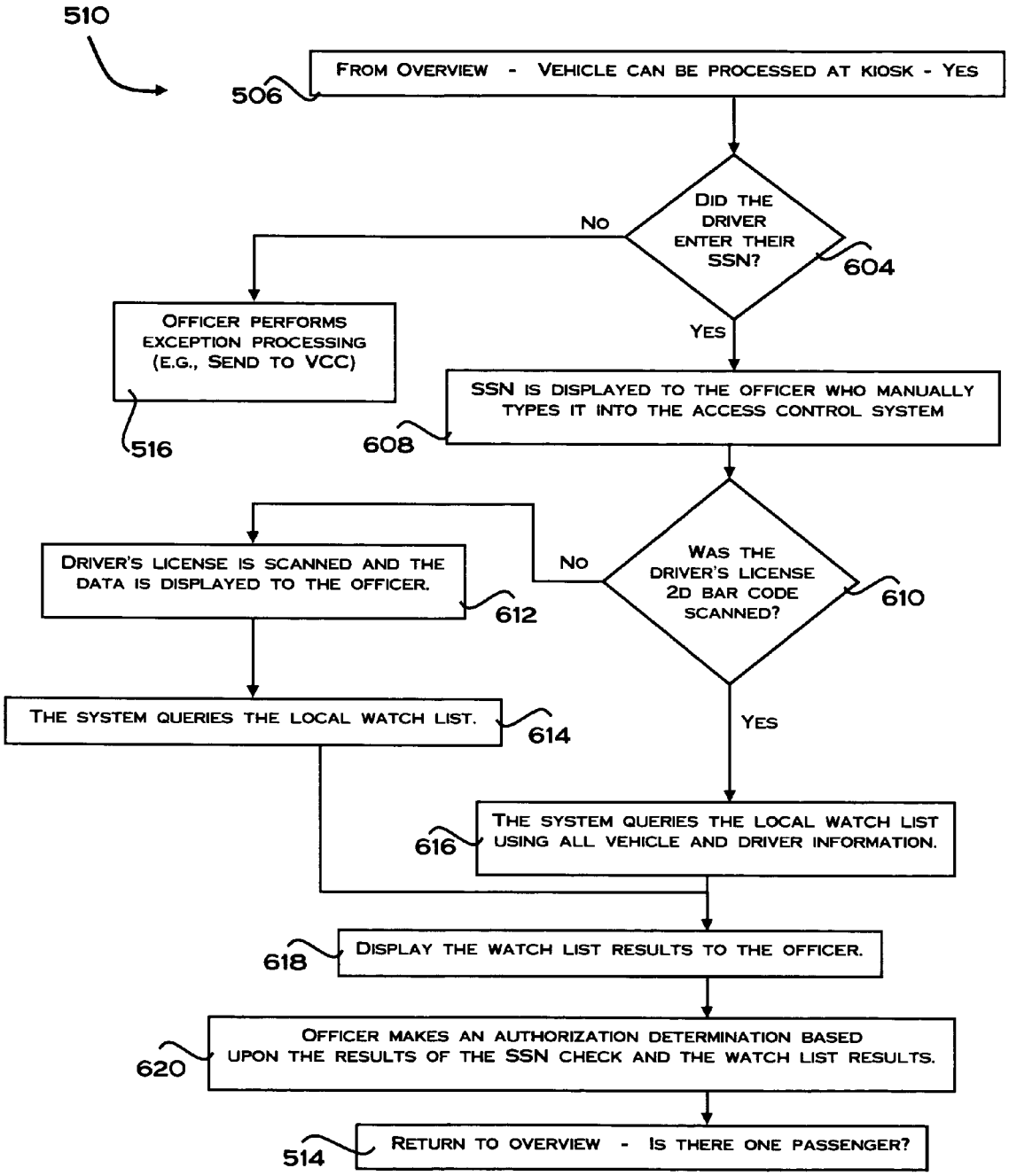
FIG. 6 illustrates a high-level flow chart of operations depicting a method that can be implemented in accordance with an alternative embodiment.

FIG. 6 illustrates a high-level flow chart of operations depicting a method 510 that can be implemented in accordance with an alternative embodiment. Note that in FIGS. 5-7, identical or similar parts or elements are generally indicated by identical reference numerals. The method 510 depicted in FIG. 6 is a more detailed breakdown of the operation depicted at block 510 in FIG. 5. Thus, as depicted at block 506, in response to a "yes" answer with respect to the test described at block 506, a test can be performed as illustrated at block 604 to determine if the driver entered his or her SSN (or other appropriate identifying information) into the kiosk 202 or 400.

If it is determined that the driver did not enter this information, then an operation is performed in which the officer performs exception process (e.g., sending the driver to the visitor center) as depicted at block 606. If, however, it is determined that the operation did enter the SSN into the kiosk 202 or 400, then the SSN and/or other appropriate information is displayed to the officer who manually types into an access control system as indicated at block 608. Thereafter, a test can be performed to determine if the driver's 2D bar code has been scanned. If it is determined that the 2D bar code has not been scanned, then as indicated at block 612, the driver's license is scanned and the data is displayed for the officer.

Thereafter, as indicated at block 614, the system 200 queries the local watch list and thereafter, the watch list results are displayed for the officer as depicted at block 618. Following processing of the operation illustrated at block 618, the officer can make an authorization determination based upon the results of the SSN check and the watch list results. Thereafter, the operation depicted at block 514 of FIG. 5 can be processed. Assuming that the diver's license 2D code was scanned, as indicated at block 610, then the operation indicated at block 616 can be processed in which the system 200 queries the local watch list using all vehicle and driver information. Thereafter, the operations indicated at block 616, 618 and so forth are processed.

Figure 7:
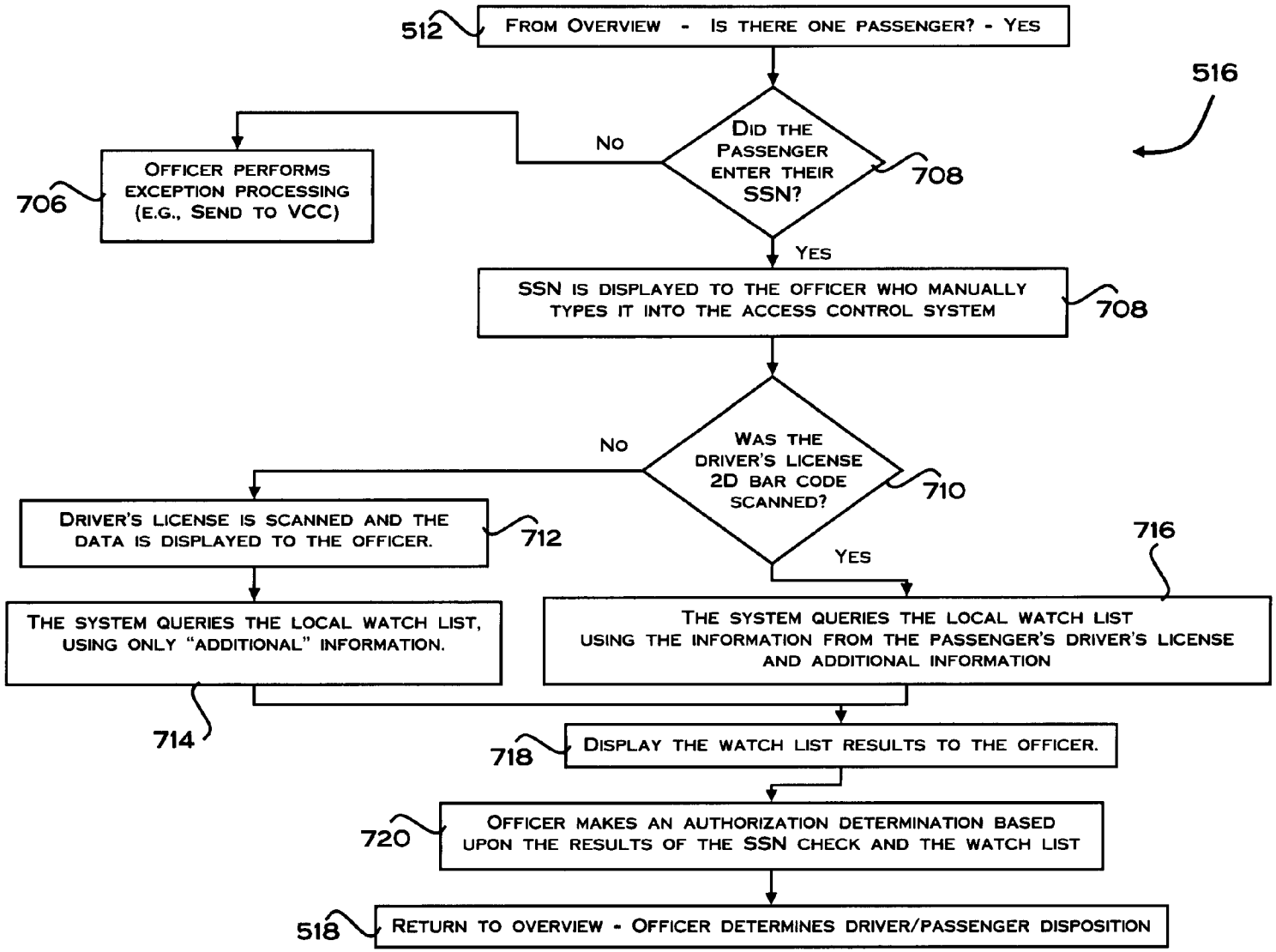
FIG. 7 illustrates a high-level flow chart of operations depicting a method that can be implemented in accordance with an alternative embodiment.

FIG. 7 illustrates a high-level flow chart of operations depicting a method 516 that can be implemented in accordance with an alternative embodiment. The method 516 depicted in FIG. 7 is a more detailed breakdown of the operation depicted at block 516 in FIG. 5. Thus, as depicted at block 512, in response to a "yes" response, a test can then be performed to determine if the passenger entered his or her SSN into the kiosk 202 or 400. If it is determined that the passenger did not enter his or SSN as depicted at block 704, then the officer performs exception processing as indicated at block 706. If, however, it is determined that the passenger did enter the SSN, then as illustrated at block 708, an operation is performed in which the SSN is displayed to the office who manually types it into the access control system.

Next, as indicated at block 710, a test is performed to determine if the driver's license 2D bar code has been scanned. If it is determined that the driver's license was not scanned, then the driver's license is scanned and the data is displayed to the officer as illustrated at block 712. Thereafter, as described at block 714, the system 200 queries the local watch list using only "additional" information. Next, as depicted at block 718, the watch list results are displayed for the officer. Thereafter, as depicted at block 720, the officer can make an authorization determination based upon the result of the SSN check and the watch list results. Note that if is determined that the driver's license 2D bar code was scanned, then as indicated at block 716, the system 200 queries the local watch list using the information from the passenger's driver license and additional information. Following processing of the operation depicted at block 716, the operations depicted at blocs 718, 720 and so on can be processed.

Figure 8:
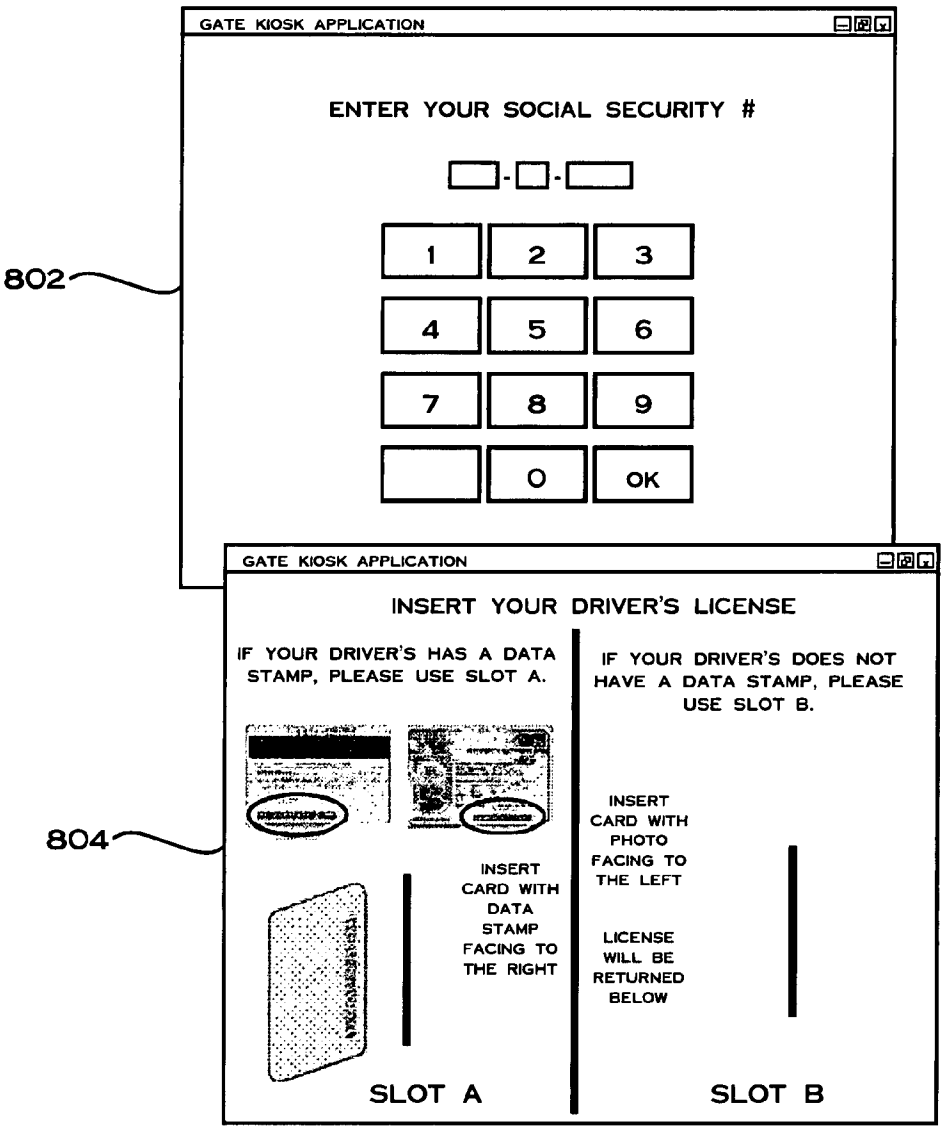
FIG. 8 illustrates a kiosk interface that can be implemented in accordance with a preferred embodiment.

FIG. 8 illustrates a kiosk interface 802 that can be implemented in accordance with a preferred embodiment. FIG. 8 also indicates an interface 804 that graphically displays instructions for a user, instructing the driver on how to insert and validate his or her driver's license into a card reader.

Figure 9:
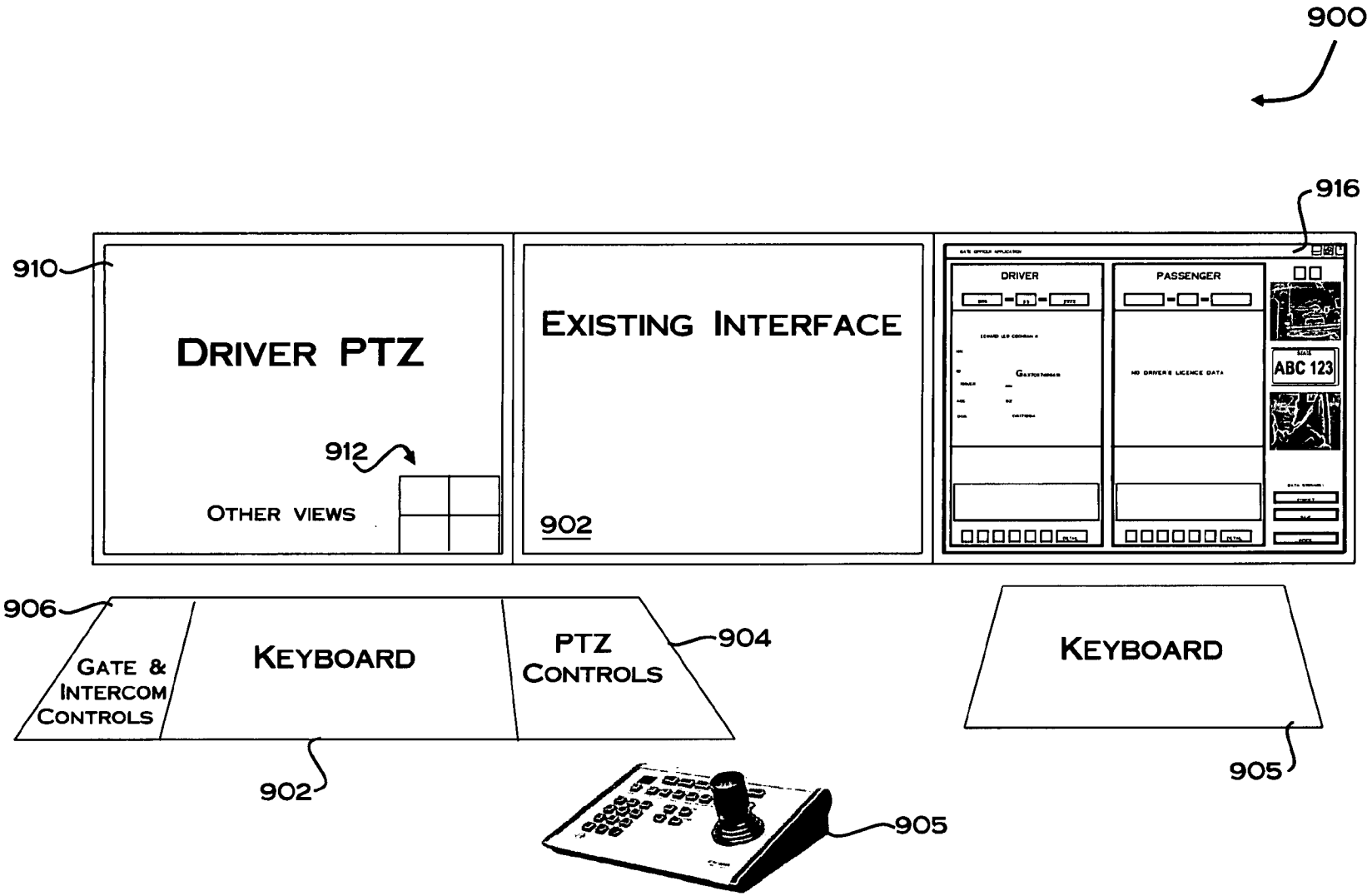
FIG. 9 illustrates an officer console system that can be implemented in accordance with an alternative embodiment.

FIG. 9 illustrates an officer console system 900 that can be implemented in accordance with an alternative embodiment. Note that the officer console system 900 can be implemented in the context of a data-processing apparatus, such as, for example, data-processing apparatus 100 depicted in FIG. 1. The officer console system 900 generally includes one or more keyboards 902, 903, which are user input devices that permit a user to input data to a device such as apparatus 100 of FIG. 1 and ultimately to system 200.

Note that keyboards 902, 903 are analogous to the use input device 127 depicted in FIG. 1. Keyboard 902 can be associated with a control section 906, which provides gate and intercom controls. Keyboard 902 also can be associated with a section that provides PTZ (Pan Tilt Zoom) controls. A plurality of display areas 910, 914 and 916 can also be provided for a user, which can provide a graphical user interface that respectively provides for driver PTZ and other views 912, an existing interface (i.e., display area 914) and an officer console via (display area 916). Using the officer console system 900 depicted in FIG. 9, a PTZ officer camera can be controlled from a user interface device such as a joy stick unit 905. All camera views can be selectable via a user input device such as a mouse.

Figure 10:
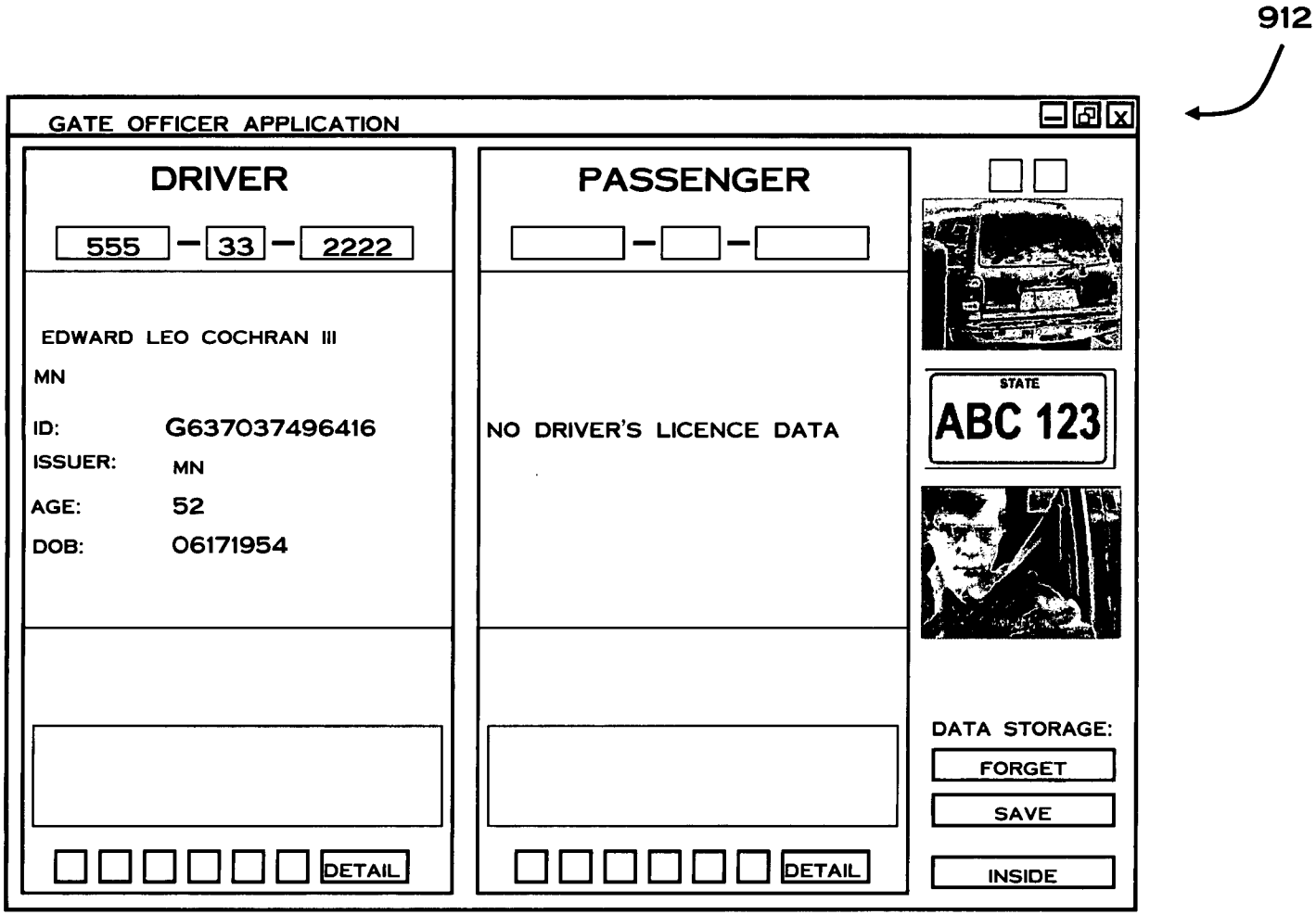
FIG. 10 illustrates a graphical user interface that can be implemented in accordance with the embodiment depicted in FIG. 9.

FIG. 10 illustrates a detailed view of the graphical user interface of display area 916 that can be implemented in accordance with the embodiment depicted in FIG. 9. The display area 916 is an interactive graphical user interface in which driver and passenger data can be displayed to the officer and entered into system 200.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A vehicle screening method, comprising:

identifying a vehicle occupant utilizing at least one biometric identifier input by said vehicle occupant to a biometric input device provided at a drive-up electronic kiosk;

identifying said vehicle occupant utilizing a barcode and an independent code associated with said barcode provided by said vehicle occupant at said drive-up electronic kiosk;

identifying said vehicle occupant utilizing an independent and unique identification number provided by said user at said drive-up electronic kiosk wherein said drive-up electronic kiosk provides a touch screen data entry function in order to match said unique identification number against a database of identification numbers;

streaming video of said vehicle occupant from a video camera provided at a drive-up electronic kiosk to a security officer; and identifying a vehicle associated with said vehicle occupant utilizing a license plate reader, thereby permitting said vehicle occupant to be remotely screened and verified for entry into a secure facility based on said at least on biometric identifier, said barcode and said independent code, said independent and unique identification number associated with said vehicle occupant, and said vehicle associated with said vehicle occupant.

2. The method of claim 1 wherein said at least one biometric identifier comprises a speech identification biometric identifier of said vehicle occupant.

3. The method of claim 1 wherein said at least one biometric identifier comprises a biometric facial identification based on a biometric facial scan of said vehicle occupant.

4. The method of claim 1 further comprising providing a kiosk for permitting said vehicle occupant to provide said at least one biometric identifier, said barcode, and said unique identification number for verifying and screening said vehicle occupant.

5. The method of claim 4 further comprising associating an interactive touch screen display with said kiosk, wherein said touch screen display permits said vehicle occupant to input said unique identification number.

6. The method of claim 4 further comprising associating a card reader with said kiosk, wherein said card reader permits said vehicle occupant to provide information from an identification card associated with said vehicle occupant.

7. The method of claim 4 further comprising associating at least one camera with said kiosk that obtains real time video of said vehicle occupant for providing said at least one biometric identifier, including a photo snapshot of said vehicle occupant for facial identification of said vehicle occupant.

8. A vehicle screening system, comprising:

a biometric input device for permitting a vehicle occupant to input at least one biometric identifier for verifying an identify of said vehicle occupant, wherein said biometric input device is configured in and maintained by a drive-up electronic kiosk;

a barcode reader for permitting said vehicle occupant to provide a barcode and an independent code associated with said barcode associated with said vehicle occupant for verifying said identity of said vehicle occupant, wherein said barcode reader is configured in and maintained by said drive-up electronic kiosk;

an a touch screen input unit for permitting a user to enter an independent and unique identification number for matching against a database of identification numbers for verification of said identity of said vehicle occupant wherein said input unit is maintained by said drive-up electronic kiosk;

an officer camera for capturing streaming video of said vehicle occupant, wherein said office camera is configured in and maintained by said drive-up electronic kiosk, and a license plate reader for identifying a vehicle associated with said vehicle occupant, thereby permitting said vehicle occupant to be remotely screened and verified for entry into a secure facility based on said at least one biometric identifier, barcode and said independent code, said independent and unique identification number, and said license plate reader.

9. The system of claim 8 wherein said at least one biometric identifier comprises a speech identification biometric identifier of said vehicle occupant.

10. The system of claim 8 wherein said at least one biometric identifier comprises a biometric facial identification based on a biometric facial scan of said vehicle occupant.

11. The system of claim 8 wherein said input unit comprises an interactive touch screen display that permits said vehicle occupant to input said unique identification number to said drive-up electronic kiosk.

12. The system of claim 8 wherein said barcode reader permits said vehicle occupant to provide to said drive-up electronic kiosk, information from an identification card associated with said vehicle occupant.

13. The system of claim 12 wherein said barcode reader reads a 1-dimensional barcode or a 2-dimensional barcode associated with said identification card.

14. The system of claim 8 wherein said biometric input device comprises at least one camera that obtains real time video of said vehicle occupant for a facial biometric identification of said vehicle occupant based on said at least one biometric identifier.

15. A vehicle screening system, comprising:

a biometric input device for permitting a vehicle occupant to input at least one biometric identifier for verifying an identify of said vehicle occupant, wherein said biometric input device is maintained by a drive-up electronic kiosk;

a reader device for permitting said vehicle occupant to provide an independent and unique code associated with said vehicle occupant for wirelessly verifying said identity of said vehicle occupant, wherein said reader device is maintained by said drive-up electronic kiosk;

an input unit for permitting a user to enter an independent and unique identification number for matching against a database of identification numbers for verification of said identity of said vehicle occupant, wherein said input unit is maintained by said drive-up electronic kiosk; and a license plate reader for identifying a vehicle associated with said vehicle occupant, thereby permitting said vehicle occupant to be remotely screened and verified for entry into a secure facility based on said at least one biometric identifier, said independent code associated with said barcode, said independent and unique identification number, and said license plate reader.

16. The system of claim 15 wherein said reader device comprises an RFID reader and said unique code comprises an RFID tag associated with said vehicle occupant and/or said reader device comprises a smartcard reader and said unique code is maintained as data on a smartcard associated with said smartcard reader, wherein said smartcard reader can retrieve said data from smartcard when input to said smartcard reader.

* * * * *

UNITED STATES PATENT AND TRADEMARK OFFICE

CERTIFICATE OF CORRECTION

PATENT NO. : 8,620,487 B2
APPLICATION NO. : 11/639815
DATED : December 31, 2013
INVENTOR(S) : Edward L. Cochran et al.

It is certified that error appears in the above-identified patent and that said Letters Patent is hereby corrected as shown below:

Title Page, Item (54) and in the Specifications, at Column 1, line 1 and 2, Title: Please delete "For a kiosk for a vehicle screening system" and insert therefore -- Design for a Kiosk for a Vehicle Screening System. --

Signed and Sealed this
Eleventh Day of March, 2014

Michelle K. Lee

Michelle K. Lee
*Deputy Director of the United States Patent and Trademark Office*